US007323954B2

(12) United States Patent
Lee et al.

(10) Patent No.: US 7,323,954 B2
(45) Date of Patent: Jan. 29, 2008

(54) DIELECTRIC CERAMIC FILTER WITH METAL GUIDE-CAN

(75) Inventors: Kie Jin Lee, Seoul (KR); Jong Cheol Kim, Seoul (KR); Seung Wan Kim, Seoul (KR)

(73) Assignee: Industry-University Cooperation Foundation Sogang University, Seoul (KR)

( * ) Notice: Subject to any disclaimer, the term of this patent is extended or adjusted under 35 U.S.C. 154(b) by 213 days.

(21) Appl. No.: 11/141,814

(22) Filed: Jun. 1, 2005

(65) Prior Publication Data

US 2005/0275489 A1 Dec. 15, 2005

(30) Foreign Application Priority Data

Jun. 9, 2004 (KR) ..... 10-2004-0042212

(51) Int. Cl.

| | |
|---|---|
| ***H01P 1/20*** | (2006.01) |
| ***H01P 7/10*** | (2006.01) |
| ***H01P 3/20*** | (2006.01) |

(52) U.S. Cl. ..... 333/202; 333/219.1; 333/208; 333/239

(58) Field of Classification Search ..... 333/202, 333/206, 208, 212, 219.1, 239
See application file for complete search history.

(56) References Cited

U.S. PATENT DOCUMENTS

| | | | | |
|---|---|---|---|---|
| 4,725,798 | A * | 2/1988 | Igarashi | 333/212 |
| 6,597,260 | B2 * | 7/2003 | Sonoda et al. | 333/134 |
| 6,677,837 | B2 * | 1/2004 | Kojima et al. | 333/208 |
| 6,977,560 | B2 * | 12/2005 | Itoh et al. | 333/26 |
| 7,132,905 | B2 * | 11/2006 | Sano | 333/26 |

FOREIGN PATENT DOCUMENTS

JP 2002084101 * 3/2002

* cited by examiner

*Primary Examiner*—Robert Pascal
*Assistant Examiner*—Kimberly E Glenn
(74) *Attorney, Agent, or Firm*—Frommer Lawrence & Haug LLP; Ronald R. Santucci

(57) ABSTRACT

A dielectric ceramic filter with a metal guide can is provided. The dielectric ceramic filter includes a metal guide can coupled to and projecting from both input/output ends of the dielectric ceramic filter. Alternatively, the dielectric ceramic filter includes: a dielectric block having a plurality of vertical grooves formed in its side surfaces, wherein a conductive material is coated on all surfaces of the dielectric block except its ends; and a metal guide can covering both ends of the dielectric block, wherein the metal guide can is a conductive metal plate projecting from both ends of the dielectric block.

13 Claims, 11 Drawing Sheets

20

DIELECTRIC CERAMIC FILTER WITH METAL GUIDE-CAN

CROSS-REFERENCE TO RELATED PATENT APPLICATION

This application claims the benefit of Korean Patent Application No. 10-2004-0042212, filed on Jun. 9, 2004, in the Korean Intellectual Property Office, the disclosure of which is incorporated herein in its entirety by reference.

BACKGROUND OF THE INVENTION

1. Field of the Invention

The present invention relates to a dielectric ceramic filter, and more particularly, to a dielectric ceramic filter connected to a metal guide can and a conductive guide line for having excellent frequency characteristics.

2. Description of the Related Art

Rapid developments in information and communication technology have placed great demand on high frequency broadband communication systems. The high frequency broadband communication system requires a high frequency filter which can operate at a high power and have superior frequency stability against temperature changes. One such filter is the dielectric ceramic filter, which uses the resonant characteristics of a dielectric resonator. Accordingly, the dielectric ceramic filter has been widely used for high frequency filtering. The dielectric ceramic filter has superior resonance characteristics at high frequencies comparing to a filter using a general LC circuit. Also, the dielectric ceramic filter has superior frequency stability against temperature change and can tolerate a high operating power.

FIG. 1A is a perspective view of a coaxial type dielectric resonator of the related art, and FIG. 1B shows the equivalent circuit of the coaxial type resonator in FIG. 1A. As shown in FIGS. 1A and 1B, the dielectric resonator 10 is a rectangular block made of a dielectric material, having a through hole 11 formed in the log axis of the block. The four side surfaces, one of the top and bottom surfaces of the rectangular dielectric block, and the inner surface of the through hole 11, are coated with a conductive material having proper conductivity such as silver (Ag) or aluminum (Al) by vacuum evaporation. That is, the dielectric resonant filter 10 is operated as an LC resonator 20 shown in FIG. 1B by opening one end and shorting other end of the rectangular dielectric block. An axial direction length of the rectangular dielectric resonator 10 is ¼ of its resonant frequency.

FIG. 2 shows a conventional assembling type dielectric ceramic filter 30 using the dielectric resonator 10. As shown in FIG. 2, the dielectric ceramic filter 30 includes a microstrip line substrate 35 and a plurality of dielectric resonators 10 arranged on the microstrip line substrate 35. Each of the dielectric resonators 10 includes a coil 32 and a capacitor 33. That is, the dielectric ceramic filter 30 uses capacitive coupling and inductive coupling. However, the dielectric ceramic filter 30 has low insertion characteristics because it uses a simple TEM mode. Also, the dielectric ceramic filter 30 has a narrow usable frequency band because of characteristic high frequency limitations. For example, at more than 5 GHz, the dielectric resonator 10 must have a short length L, which is very difficult to manufacture with sufficient accuracy.

To overcome this disadvantage, another conventional dielectric ceramic filter 40 has been introduced, as shown in FIG. 3. As shown in FIG. 3, the conventional dielectric ceramic filter 40 is manufactured by forming a plurality of vertical grooves on both sides of a dielectric block 41, forming a conductive layer on the four side surfaces but not the ends of the dielectric block 41, and mounting the dielectric block 41 on a substrate 44 having a microstrip line 44. However, the conventional dielectric resonator filter 40 does not completely overcome the disadvantages of the coaxial type dielectric ceramic filter 30.

Furthermore, the conventional dielectric resonator filter 40 has a problem of an impedance matching between the input and output ends of the dielectric resonator filter 40 and a connection terminal of an external device, which is necessary to obtain sufficient filter characteristics. If the impedance is not accurately matched, excessive signal loss may occur.

The impedance matching problem can be overcome by controlling the length and width of a microwave incident electrode 45 and a microwave incident pattern 46. However, this control is limited in the conventional dielectric ceramic filter 40, since the impedance changes suddenly at the input and output ends where the dielectric material contacts air. Moreover, the filter characteristics such as insertion and attenuation decrease considerably because the electromagnetic field radiates to a space between the electrode and a conductive guide line at the input/output ends when impedance matching is not achieved.

SUMMARY OF THE INVENTION

The present invention provides a dielectric ceramic filter with a metal guide can at the input/output ends to match their impedance, in order to provide superior insertion and filtering characteristics in a high frequency band.

According to an aspect of the present invention, there is provided a dielectric ceramic filter having a dielectric block mounted on a microstrip line substrate, including: a metal guide can coupled to both input/output ends of the dielectric ceramic filter, and projecting from the input/output ends, wherein the metal guide can is a conductive metal plate surrounding a portion of the upper surface of the dielectric block and a portion of the side surfaces of the dielectric block. The metal guide projects to cover the microstrip line.

A groove is formed in the upper surface of the metal guide can. The groove may completely penetrate the upper surface to divide the metal guide can into two parts. Also, the groove is wider at an entrance part of the metal guide can.

A plurality of vertical grooves may be formed in both sides of the dielectric block and a conductive material may be coated on all surfaces of the dielectric block excepting its ends. A conductive guide line and an electrode may be formed on the ends of the dielectric block where the conductive material is not coated, the electrode may be electrically connected to a microstrip line of the microstrip line substrate, and the conductive guide line is grounded.

According to another aspect of the present invention, there is provided a dielectric ceramic filter, including: a dielectric block having a plurality of vertical grooves formed in its side surfaces, wherein a conductive material is coated on all surfaces of the dielectric block except its ends; and a metal guide can surrounding both ends of the dielectric block, wherein the metal guide can is a conductive metal plate projecting from both ends of the dielectric block. An electrode is formed on both end surfaces of the dielectric block.

The dielectric ceramic filter may further include input/output terminals electrically connected to the electrode on the upper surface of both ends of the dielectric block.

The metal guide can may project from the ends of the dielectric block. An opening or a groove may be formed in the upper surface of the metal guide can. The groove may be wider at an entrance portion of the metal guide can.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 4:
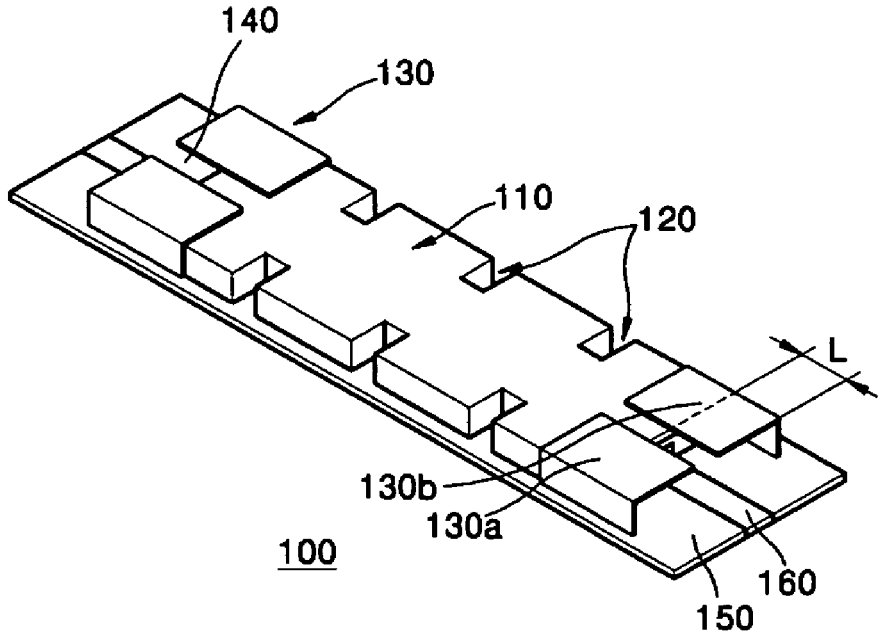
FIG. 4 is a perspective view of a dielectric ceramic filter having a metal guide can in accordance with a first embodiment of the present invention.

FIG. 4 is a perspective view of a dielectric waveguide-type ceramic filter having a metal guide can in accordance with a first embodiment of the present invention. As shown in FIG. 4, the dielectric waveguide-type ceramic filter 100 includes a dielectric block 110 mounted on a microstrip line substrate 150 and metal guide cans 130 connected to both input/output ends of the dielectric block 110. In the first embodiment of the present invention, the metal guide cans 130 are connected to the input/output ends of the conventional dielectric ceramic filter 40 to accurately match the impedance of the input/output ends of the dielectric waveguide type ceramic filter 100 by reducing the impedance difference between the air and the input/output ends. Accordingly, microwaves from the microstrip line 160 can pass through the dielectric block 110 of the dielectric ceramic filter 100 without loss since the impedance of the input/output ends of the dielectric ceramic filter 100 and a connection terminal of an external device can be easily matched by reducing the impedance difference caused by the medium difference when transferring microwaves to the dielectric block 110.

As in the related art, a plurality of vertical grooves 120 is formed on both sides of the dielectric block 110. The lengths and widths of the vertical grooves 120 differ according to the target frequency band. That is, the length and width of each vertical groove can be specified according to the target frequency passband. This is well-known to those of ordinary skill in the art and will not be explained here.

A conductive material is coated on the side surfaces of the dielectric block 110 but not the ends. A material having high conductivity is used for this, such as silver (Ag) or aluminum (Al). By using vacuum evaporation to coat the conductive material on the dielectric block 110 to forming a conductive layer, the dielectric block 110 operates as a dielectric resonator.

Figure 5A:
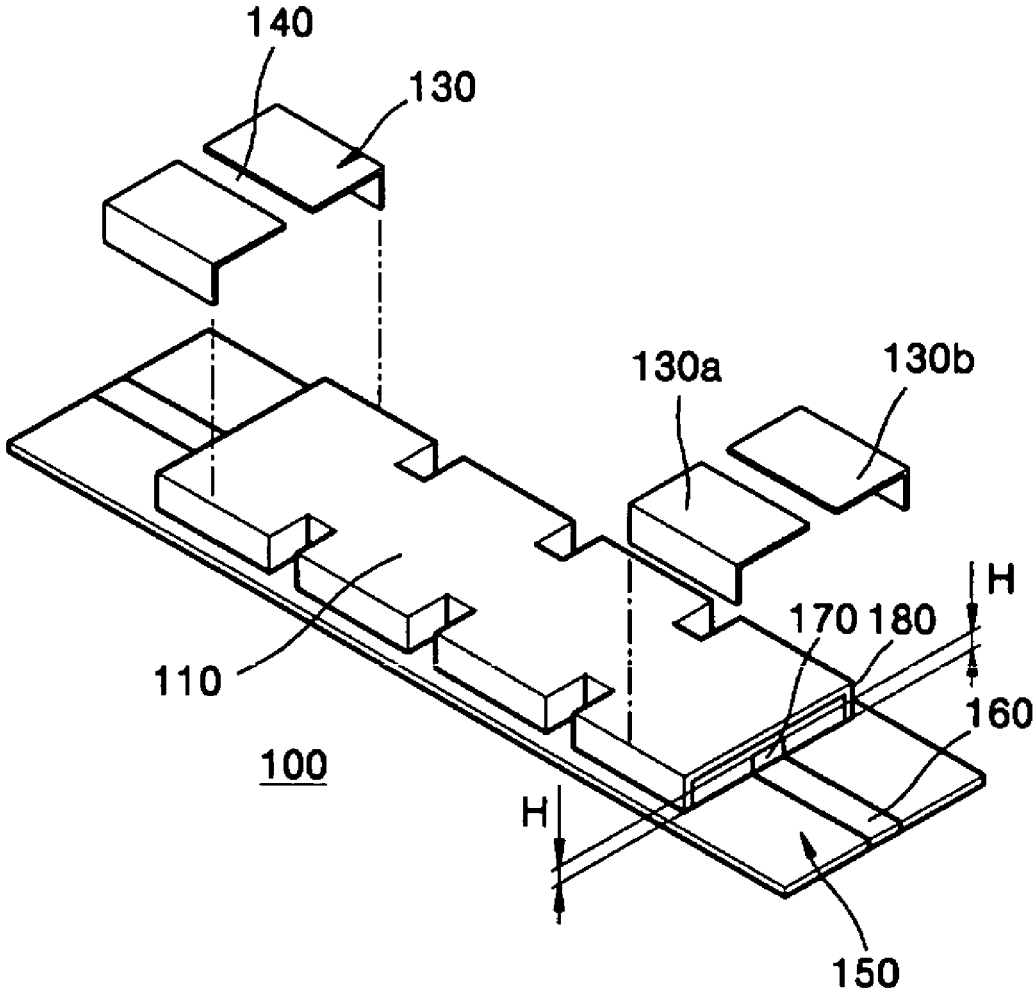
FIG. 5A is a exploded perspective view of a dielectric waveguide-type ceramic filter 100.

FIG. 5A is an exploded perspective view of the dielectric waveguide-type ceramic filter 100. As shown in FIG. 5A, a conductive guide line 180 and an electrode 170 are formed on both ends of the dielectric block 110. The dielectric block 110 with the conductive guide line 180 and the electrode 170 is firmly soldered to the microstrip line substrate 150. The electrode 170 is electrically connected to the microstrip line 160 of the microstrip line substrate 150 by a conductive material such as solder, to transfer the microwaves between the dielectric block 110 and the microstrip line 160. The conductive guide line 180 is formed along the edges of the end surface of the dielectric block 110, and is connected to the metal guide can 130 and a ground (not shown) of the microstrip line substrate 150.

Figure 5B:
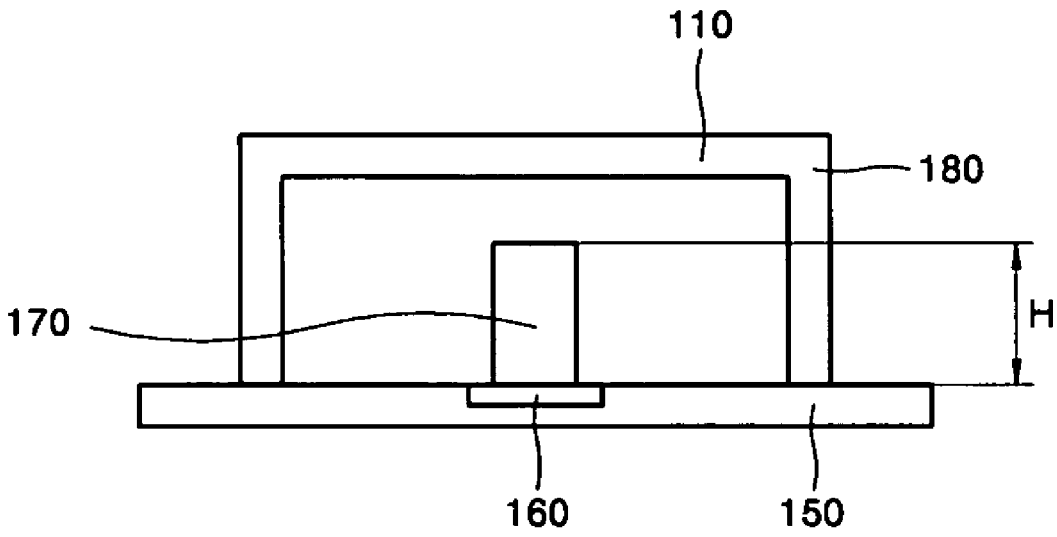
FIG. 5B is a front view showing a conductive guide line formed on both ends of the dielectric block mounted on a microstrip line substrate.

FIG. 5B is a front view of one end of the dielectric block 110 on the microstrip line substrate 150. As shown in FIG. 5B, the electrode 170 formed on the end of the dielectric block 110 is connected to the microstrip line 160. The conductive guide line 180 has a predetermined width and is formed along the edges of one end surface of the dielectric block 110 which is not coated with the conductive material, except one edge which does not contact the microstrip line substrate 150. Accordingly, the conductive guide line 180 has a "∩" shape as shown.

By controlling the size and shape of the conductive guide line 180, the frequency characteristics and impedance of the dielectric ceramic filter 100 can be finely controlled. Also, the length and width of the microstrip line 160 and the electrode 170 are designed according to the target frequency characteristics. The height H of the electrode 170 is in inverse proportion to the projected length L of the metal guide can 130 from the end surface of the dielectric block 110. For example, if the electrode 170 is higher, the metal guide can 130 must be shorter to obtain the same frequency characteristics. Conversely, if the electrode 170 is lower, the metal guide can 130 must be longer. This relationship between the height of the electrode 170 and the length of the metal guide can 130 is shown by the following equation.

$$H = \alpha \frac{1}{L}, \text{ wherein } \alpha \text{ is a proportional factor} \qquad \text{Eq. 1}$$

At both ends of the dielectric block 110, a thin metal plate of the metal guide can 130 is connected. The metal guide can 130 may be manufactured from metal. As shown in FIG. 5A, the metal guide can 130 is connected to both the side surface and the upper surface of the dielectric block 110. The metal guide can 130 may be divided into two parts 130*a* and 130*b* separated by a space. That is, the metal guide can 130 has the shape of an upside down cup and can be divided by a longitudinal groove in its upper surface. By connecting the metal guide can 130 to the upper surface and the side surface of the dielectric block 110, a conductive coating layer of the dielectric block 110 electrically contacts the metal guide can 130 and the microstrip line substrate 160.

The metal guide can 130 projects from the end surface of the dielectric block 110 to cover the microstrip line 160. Accordingly, the length of the metal guide can 130 may be varied according to the length of the microstrip line 160. By covering the microstrip line 160, the field radiated in the space between the electrode 170 and the conductive guide line 180 is minimized. Accordingly, the metal guide can 130 prevents the field radiation from decreasing filter characteristics such as insertion and attenuation.

As shown in FIG. 4, the groove 140 is formed between two parts 130*a* and 130*b* of the metal guide can 130, and is used for trimming. That is, a tool may be inserted into the groove 140 to reach the electrode 170 and the conductive guide line 180 which are covered by the metal guide can 130. Therefore, the shape of the electrode 170 and the conductive guide line 180 can be modified by inserting the tool through the groove 140 to finely control the frequency characteristics, after assembling the dielectric ceramic filter 100. Accordingly, it is not necessary to remove the metal guide can 130 from the dielectric ceramic filter 100 for trimming. Therefore, trimming can be easily performed.

Figure 5C:
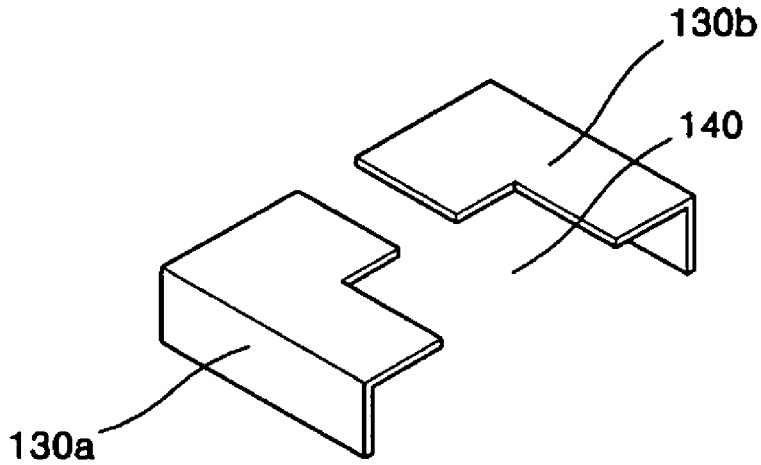
FIG. 5C is a diagram illustrating another embodiment of a metal guide can shown in FIG. 4.

As shown in FIG. 5C, the groove 140 may be wider at the entrance of the metal guide can 130. Forming the wider part of the groove 140 allows the tool to be conveniently inserted through the groove 140 to reach the target part of the dielectric block 110.

Figure 6A:
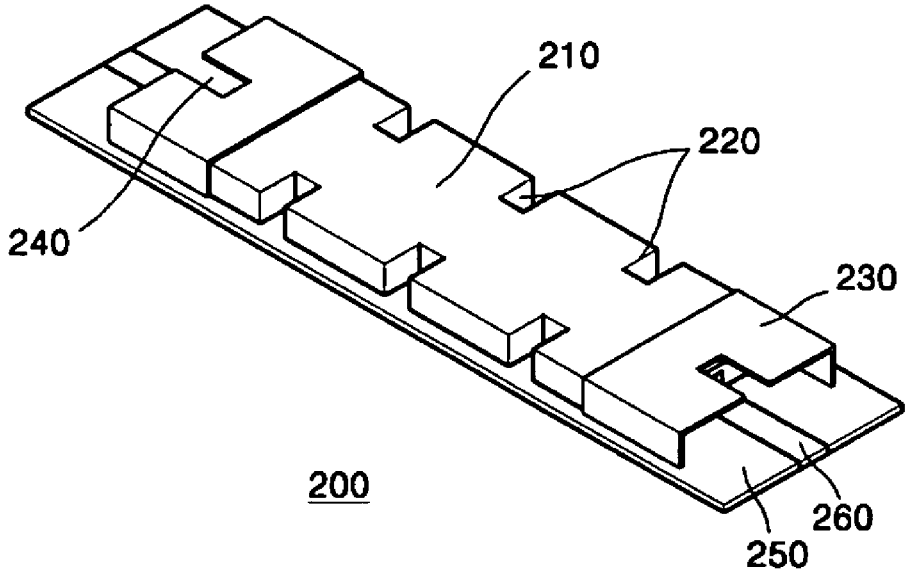
FIG. 6A is a perspective view of a dielectric ceramic filter with a metal guide can in accordance with another embodiment of the present invention.
Figure 6B:
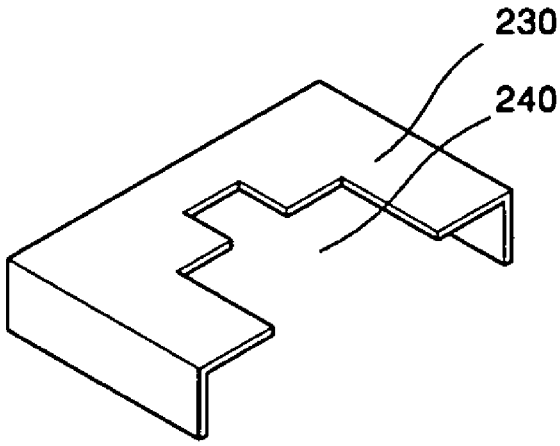
FIG. 6B is a diagram illustrating another embodiment of a metal guide can shown in FIG. 6A.

FIG. 6A is a perspective view of a dielectric ceramic filter 200 with a metal guide can in accordance with a second embodiment of the present invention. The dielectric ceramic filter 200 is similar to the dielectric ceramic filter 100 in FIG. 4, except for the shape of the metal guide can. A dielectric block 210 and a microstrip line substrate 250 have the same shapes and connection relations as in the dielectric ceramic filter 100. In the first embodiment, the metal guide can 130 is divided into two parts 130*a* and 130*b*, but in the second embodiment, the metal guide can 230 is not divided. The metal guide can 230 is coupled to each end of the dielectric block 210. As shown in FIG. 6B, a groove 240 is formed at the entrance of the upper surface of the metal guide can 230. The groove 240 may be wider at the entrance portion of the metal guide can 230. In view of performance, the first and second embodiments of the present invention are identical.

Figure 7A:
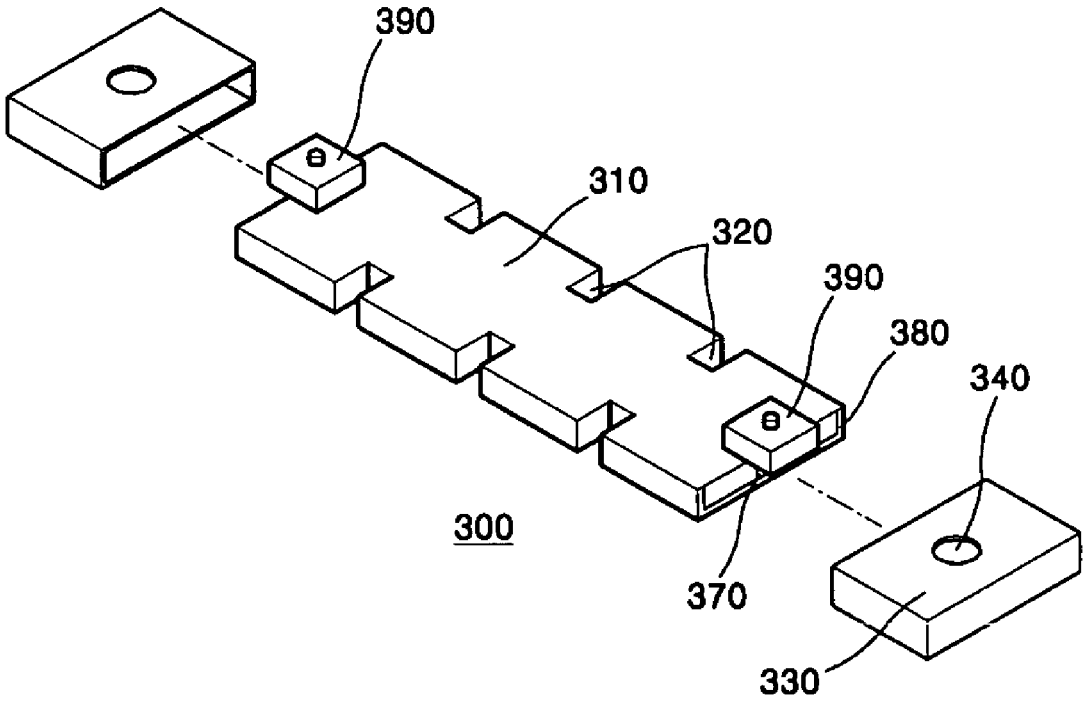
FIG. 7A is a perspective view of a dielectric ceramic filter with a metal guide can in accordance with another embodiment of the present invention.

FIG. 7A is a perspective view of a dielectric ceramic filter 300 with a metal guide can in accordance with a third embodiment of the present invention. As shown in FIG. 7A, the dielectric ceramic filter 300 of the third embodiment is distinguishable from the first and the second embodiments by the absence of a microstrip line substrate. A plurality of vertical grooves 320 are formed on both sides of a dielectric block 310. A conductive material is coated on the side surfaces but not the ends of the dielectric block 310. An electrode 370 and a conductive guide line 380 are formed on both end surfaces of the dielectric block 310.

However, additional input/output terminals 390 are formed on both ends of the dielectric block 310, because a microstrip line is not included. The input/output terminals 390 are electrically connected to the electrodes 370.

Figure 7B:
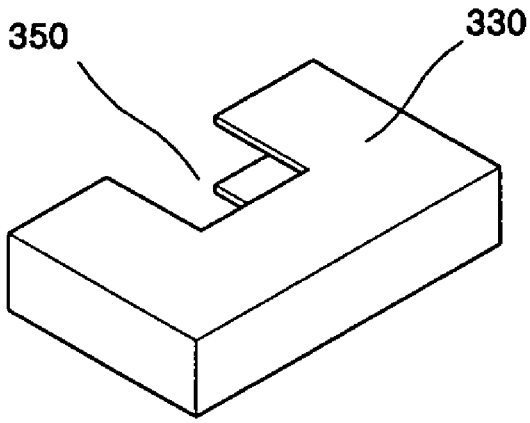
FIG. 7B is a diagram illustrating another embodiment of a metal guide can shown in FIG. 7A.

As shown in FIG. 7A, the metal guide can 330 has the shape of a rectangular cap completely surrounding the end of the dielectric block 310. Both ends of the metal guide can 330 may be open. However, it is preferable that one end of the metal guide can 330 is open and the other end is closed, to minimize the field radiation. As in the first and second embodiments, the metal guide can 330 projects from the end of the dielectric block 310. The metal guide can 330 includes an opening 340 on its upper surface for trimming. Also, as shown in FIG. 7B, a groove 350 may be partially formed on the metal guide can 330 toward dielectric block 310. That is, the groove 350 may be formed in the side of the metal guide can 330 which contacts the dielectric block 310.

The dielectric ceramic filter 300 may be directly installed on a circuit board of a high frequency device such as a communication device or a repeater, without coupling it to the microstrip line substrate.

Figure 8:
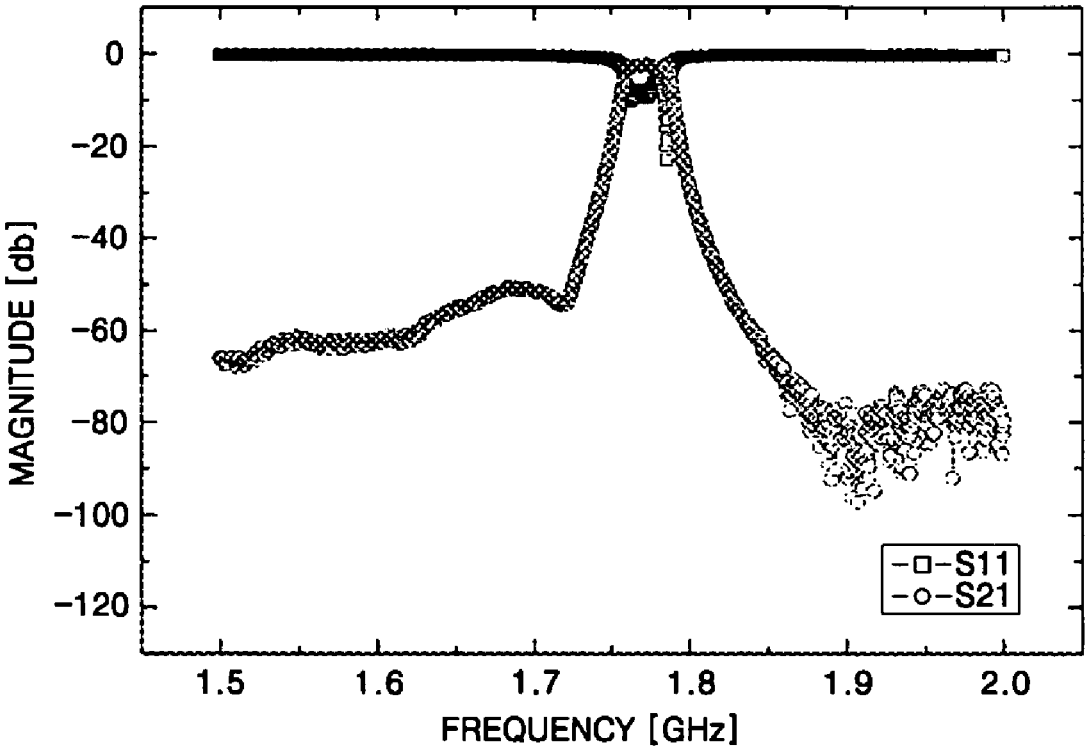
FIG. 8 is a graph showing frequency response characteristics of the conventional dielectric ceramic filter 40 in FIG. 3.
Figure 9:
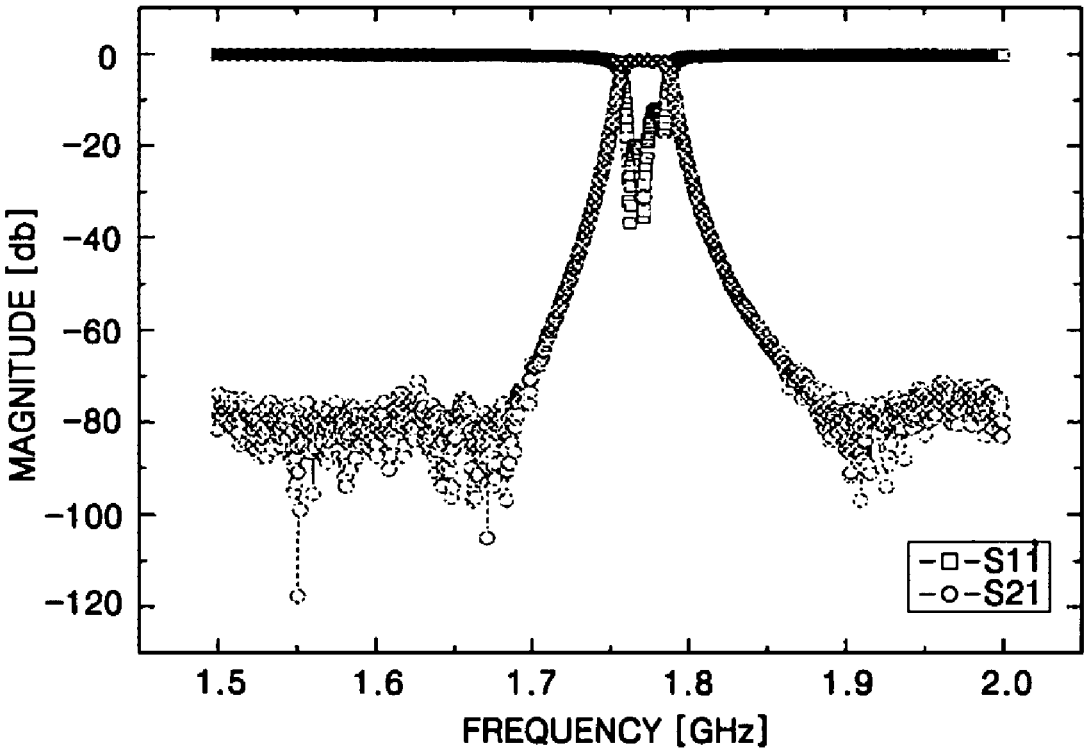
FIG. 9 is a graph illustrating frequency response characteristics of the dielectric ceramic filter 200 of the second embodiment in FIG. 6A.

The frequency response characteristics of the dielectric ceramic filter with a metal guide can of the present invention and the conventional dielectric ceramic filter will be compared and explained referring to FIGS. 8 and 9. FIG. 8 is a graph showing the frequency response characteristics of the conventional dielectric ceramic filter 40 in FIG. 3. FIG. 9 is a graph illustrating the frequency response characteristics of the dielectric ceramic filter 200 in FIG. 6A. The curve of symbols '□' represents the magnitude of a reflection loss S11 which is returned from the input/output ends, and a curve of symbols '○' denotes the magnitude of a signal S21 output from the output end.

As shown in the two graphs, the dielectric ceramic filter 200 has superior characteristics to the conventional dielectric ceramic filter 40. That is, there is almost no returned signal (reflection loss) below about −40 dB as shown in the graph of the second embodiment. This means that the impedance is accurately matched. In the case of the conventional dielectric ceramic filter, about −10 dB of reflection loss is shown in the graph in FIG. 8. Therefore, the conventional dielectric ceramic filter has a larger reflection loss than the dielectric ceramic filter 200.

The outputs of the dielectric ceramic filter 200 are accurately symmetrical about the resonant frequency, as shown in FIG. 9. However, the outputs of the conventional dielectric ceramic filter 40 as shown in FIG. 8 are not accurately symmetrical about the resonant frequency. The conventional dielectric ceramic filter 40 outputs a 10 dB higher signal below the resonant frequency for example at 1.5 GHz, than the dielectric ceramic filter 200. That is, the output signal of the conventional dielectric ceramic filter 40 is not sharply formed around the resonant frequency. Therefore, the dielectric ceramic filter 200 of the present invention provides superior impedance matching and frequency response characteristics.

Figure 1A:
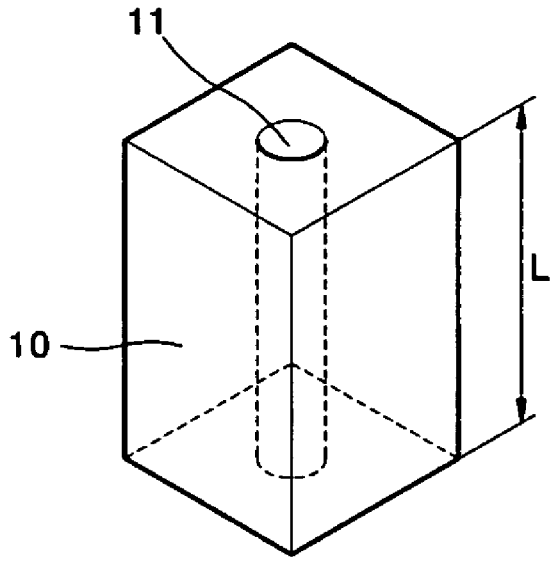
FIG. 1A (PRIOR ART)
FIG. 1A is a perspective view of a coaxial type dielectric resonator in accordance with the related art.
Figure 1B:
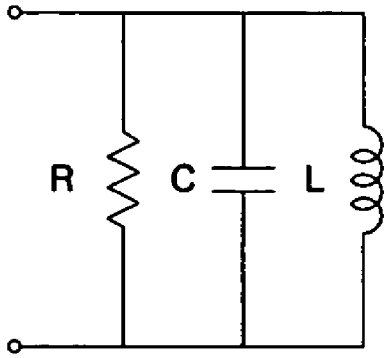
FIG. 1B(PRIOR ART)
FIG. 1B shows the equivalent circuit of the coaxial type resonator in FIG. 1A.
Figure 2:
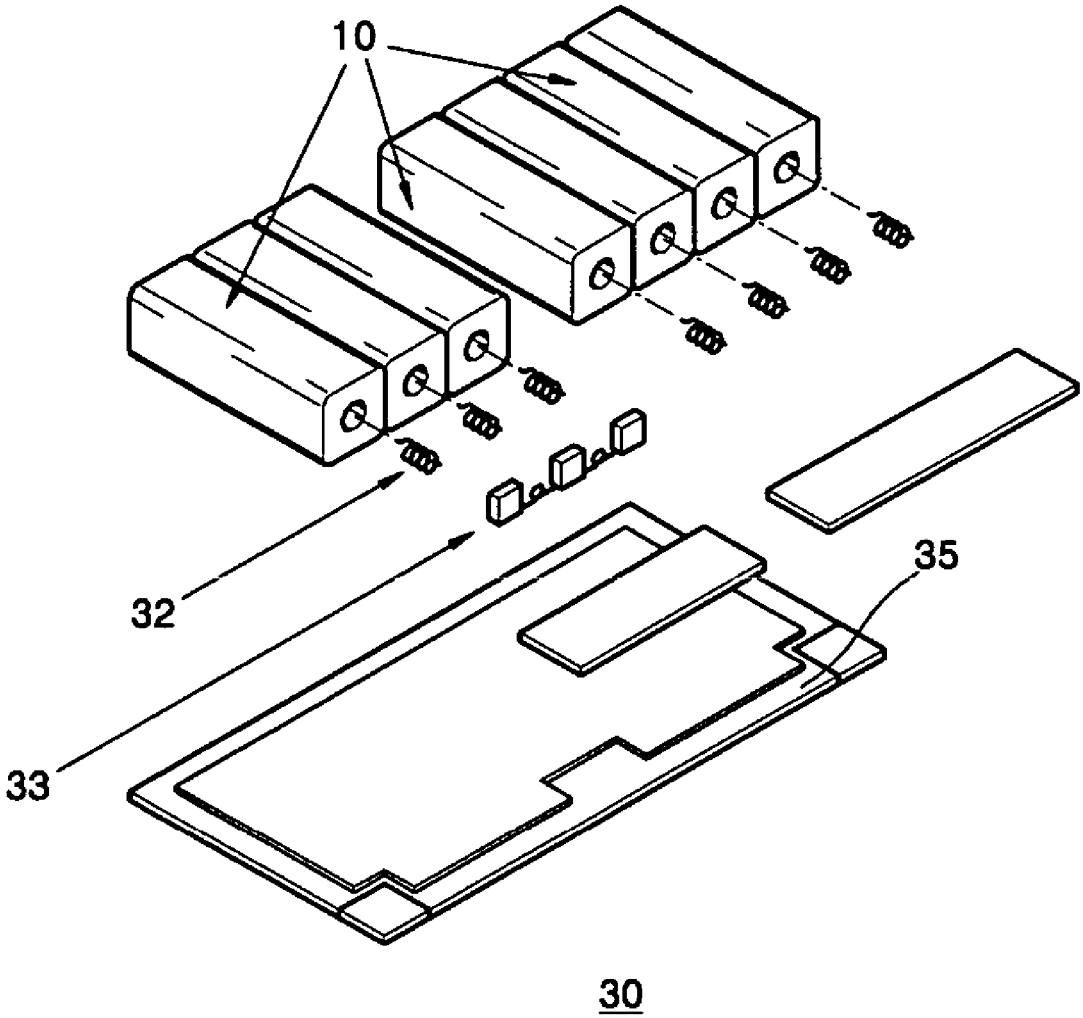
FIG. 2 (PRIOR ART)
FIG. 2 shows a conventional dielectric ceramic filter using a coaxial type dielectric resonator.
Figure 3:
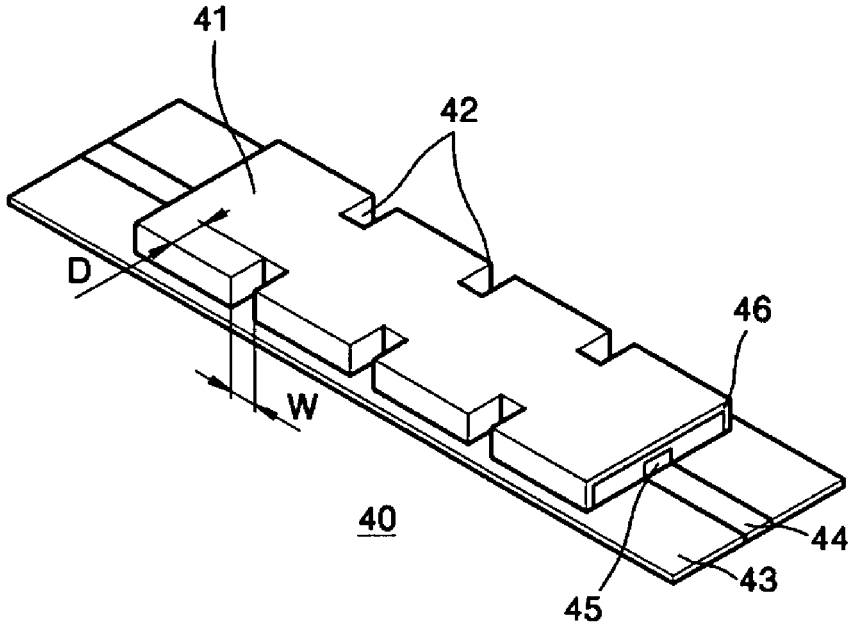
FIG. 3 (PRIOR ART)
FIG. 3 is a perspective view of another conventional dielectric ceramic filter.
Figure 10:
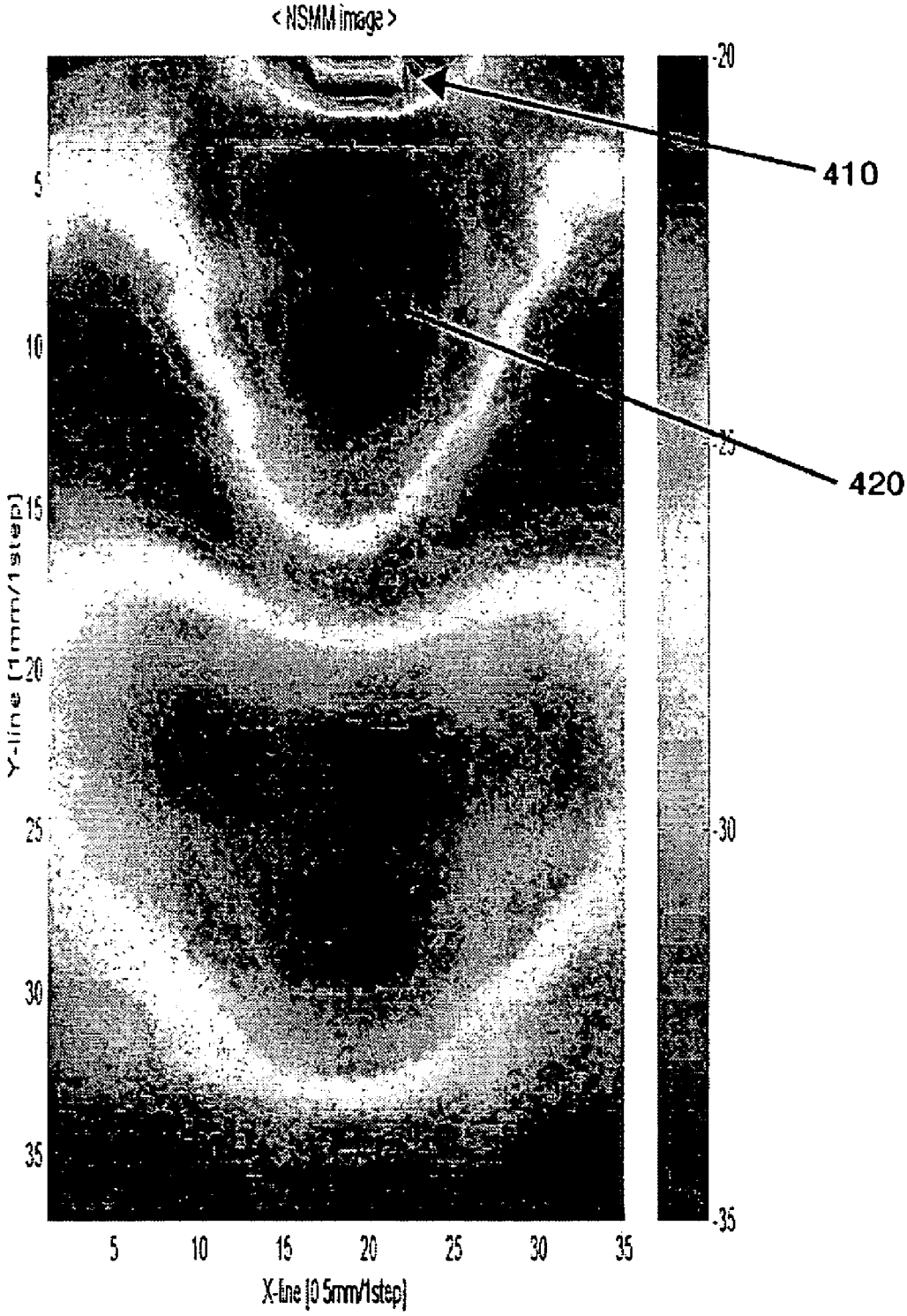
FIG. 10 is a graph showing the two-dimensional frequency distribution of the conventional dielectric ceramic filter shown in FIG. 3.
Figure 11:
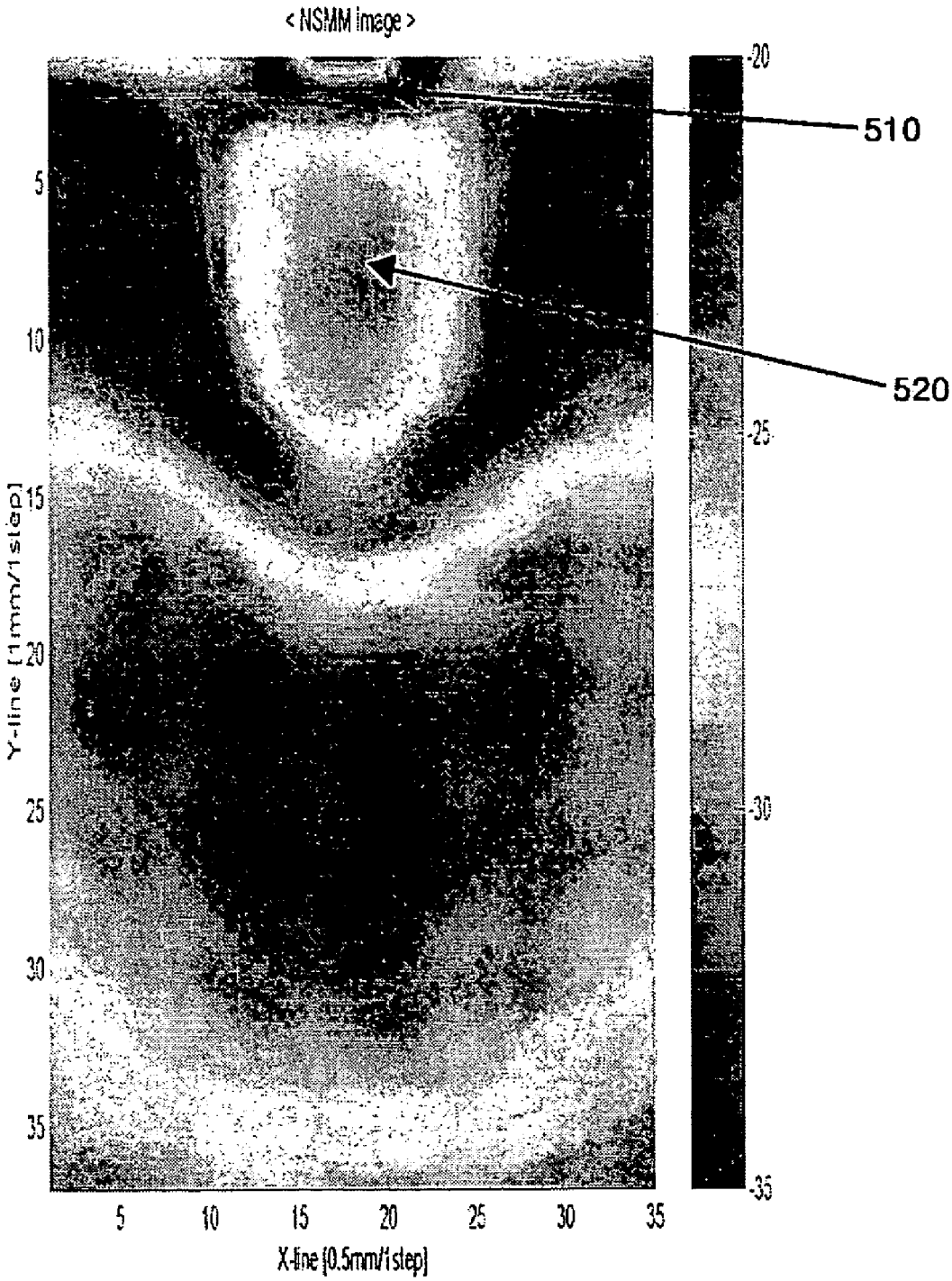
FIG. 11 is a graph showing the two-dimensional frequency distribution of the dielectric ceramic filter shown in FIG. 6A.

FIG. 10 is a graph showing the two-dimensional frequency distribution of the conventional dielectric ceramic filter 40 of FIG. 3, and FIG. 11 is a graph showing the two-dimensional frequency distribution of the dielectric ceramic filter 200 of the second embodiment of FIG. 6A. As shown in FIGS. 10 and 11, the microwave matching of the dielectric ceramic filter of the second embodiment is improved by the metal guide can compared with the conventional dielectric ceramic filter 40.

Referring to FIG. 10, a numeral reference 410 represents a two-dimensional image of microwave distribution generated around the electrode 45 at the input end of the conventional dielectric ceramic filter 40. A numeral reference 420 shows a two-dimensional image of microwaves generated at a location 5 mm inside the dielectric block 41. Referring to FIG. 11, a number reference 510 represents a two-dimensional image of microwave distribution generated around the input end of the dielectric ceramic filter 200 of the present invention. A numeral reference 520 shows a two-dimensional image of microwaves generated at a location 5 mm inside the dielectric block of the dielectric ceramic filter 200 with the metal guide can. The differences between the microwave images 410 and 510 are the width and size of the microwaves distribution formed around the electrode. As shown in FIGS. 10 and 11, the dielectric ceramic filter with the metal guide can forms a wider and stronger microwave Image guide line than the conventional dielectric ceramic filter. Therefore, the graphs show that the metal guide can compensates for the impedance difference caused by the medium difference. Therefore, the metal guide can minimizes loss caused by the impedance difference at the input/output ends, improving the filter characteristics.

As mentioned above, the metal guide can coupled to both ends of the dielectric block minimizes loss caused by impedance differences and improves the impedance matching. Accordingly, the frequency response characteristics of the dielectric ceramic filter of the present invention are dramatically improved. Furthermore, the width of the conductive guide line formed on both ends of the dielectric block and the groove formed on the upper surface of the metal guide can are used for convenient trimming and finely controlling the characteristics after completely manufacturing the dielectric ceramic filter. Therefore, the filter characteristics and the efficiency of manufacture are further improved. Moreover, the field radiation is minimized by the metal guide can.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A dielectric ceramic filter having a dielectric block mounted on a microstrip line substrate having a microstrip line, comprising:

a metal guide can coupled to both input/output ends of the dielectric ceramic filter, projecting from both of the input/output ends, wherein the metal guide can is a conductive metal plate covering a portion of the upper surface of the dielectric block and a portion of the side surfaces of the dielectric block, and wherein a groove is formed in the upper surface of the metal guide can.

2. The dielectric ceramic filter of claim 1, wherein the metal guide can is so projected as to cover the microstrip line.

3. The dielectric ceramic filter of claim 1, wherein the groove completely penetrates the upper surface and divides the metal guide can into two parts.

4. The dielectric ceramic filter of claim 1, wherein the groove is wider at an entrance part of the metal guide can.

5. The dielectric ceramic filter of claim 1, wherein a plurality of vertical grooves are formed on both sides of the dielectric block and a conductive material is coated on all surfaces of the dielectric block except its ends.

6. The dielectric ceramic filter of claim 5, wherein a conductive guide line and an electrode are formed on both ends of the dielectric block where the conductive material is not coated, the electrode is electrically connected to a microstrip line of the microstrip line substrate, and the conductive guide line is grounded.

7. The dielectric ceramic filter of claim 6, wherein the conductive guide line is formed along the edges of the end of the dielectric block except the edge which the microstrip line substrate does not contact.

8. The dielectric ceramic filter of claim 7, wherein the conductive guide line formed on the end of the dielectric block is connected to the metal guide can.

9. The dielectric ceramic filter of claim 6, wherein the height of the electrode is in inverse proportion to the length of the metal guide can projecting from the end of the dielectric block.

10. A dielectric ceramic filter comprising:

a dielectric block having a plurality of vertical grooves formed in the side surfaces, of the dielectric block, wherein a conductive material is coated on all surfaces of the dielectric block except the ends of the dielectric block;

a metal guide can surrounding both ends of the dielectric block, wherein the metal guide can is a conductive metal plate projecting from both ends of the dielectric block;

a conductive guide line and an electrode formed on both end surfaces of the dielectric block; and input/output terminals electrically connected to the electrode on the upper surface of both ends of the dielectric block.

11. The dielectric ceramic filter of claim 10, wherein one end of the projecting metal guide can is closed with an identical conductive metal.

12. The dielectric ceramic filter of claim 10, wherein an opening is formed on the upper surface of the metal guide can.

13. The dielectric ceramic filter of claim 10, wherein a groove is formed in the upper surface of the metal guide can.

* * * * *